United States Patent [19]

Gutter et al.

[11] Patent Number: 4,767,345

[45] Date of Patent: Aug. 30, 1988

[54] HIGH-DENSITY, MODULAR, ELECTRICAL CONNECTOR

[75] Inventors: David H. Gutter; Walter C. Shatto, Jr., both of Harrisburg, Pa.

[73] Assignee: AMP Incorporated, Harrisburg, Pa.

[21] Appl. No.: 31,492

[22] Filed: Mar. 27, 1987

[51] Int. Cl.[4] ..... H01R 4/66

[52] U.S. Cl. ..... 439/92; 439/594; 439/660

[58] Field of Search ..... 439/92, 98, 108, 578–581, 439/585, 594–596, 598, 599, 658, 660, 701, 708–710, 712, 718, 723, 724, 875, 880

[56] References Cited

U.S. PATENT DOCUMENTS

| | | | |
|---|---|---|---|
| 3,325,770 | 6/1967 | Hammell et al. | 339/176 |
| 3,474,394 | 10/1969 | Hammell et al. | 339/176 |
| 4,067,633 | 1/1978 | Groft et al. | 339/74 R |
| 4,083,615 | 4/1978 | Jolinskie | 339/176 M |
| 4,243,288 | 1/1981 | Lucius et al. | 339/99 R |
| 4,310,208 | 1/1982 | Webster et al. | 339/14 R |
| 4,379,361 | 4/1983 | Webster et al. | 29/857 |
| 4,444,450 | 4/1984 | Huber | 339/91 B |
| 4,451,099 | 5/1984 | Bricker, Jr. et al. | 439/660 |
| 4,484,792 | 11/1984 | Tengler et al. | 339/143 R |
| 4,491,381 | 1/1985 | Hamsher, Jr. et al. | 439/92 |
| 4,586,769 | 5/1986 | Tengler et al. | 339/59 R |
| 4,626,054 | 12/1986 | Tengler et al. | 439/594 |
| 4,690,647 | 9/1987 | Hamsher, Jr. et al. | 439/92 |
| 4,737,118 | 4/1988 | Lockard | 439/594 |

FOREIGN PATENT DOCUMENTS

| | | |
|---|---|---|
| 0072063 | 7/1982 | European Pat. Off. . |
| 8501751 | 6/1985 | Netherlands . |

OTHER PUBLICATIONS

IBM Technical Disclosure Bulletin–vol. 7, No. 11, Apr. '65, p. 989.

*Primary Examiner*—Gil Weidenfeld
*Assistant Examiner*—Paula A. Austin
*Attorney, Agent, or Firm*—Gerald K. Kita

[57] ABSTRACT

A high-density, electrical, connector for discrete wire coaxial cables includes one or more housing modules (21*a*, 21*b*, 21*c*, 121), adapted to receive one or more termination members (14, 126*a*, 126*b*) attached to the ends of coaxial cables (16, 116). Each termination member comprises a dielectric support (51, 134) having a signal contact (52, 142) supported on one side thereof and a ground contact (53, 131) supported on the opposite side thereof. The contacts include first and second connections (58, 61) on the same side of the support (51, 134) and substantially aligned with one another and with the cable. The ground contact (53, 131) includes a third crimp connection (60), aligned with the first and second connections (58, 61) and the cable.

33 Claims, 2 Drawing Sheets

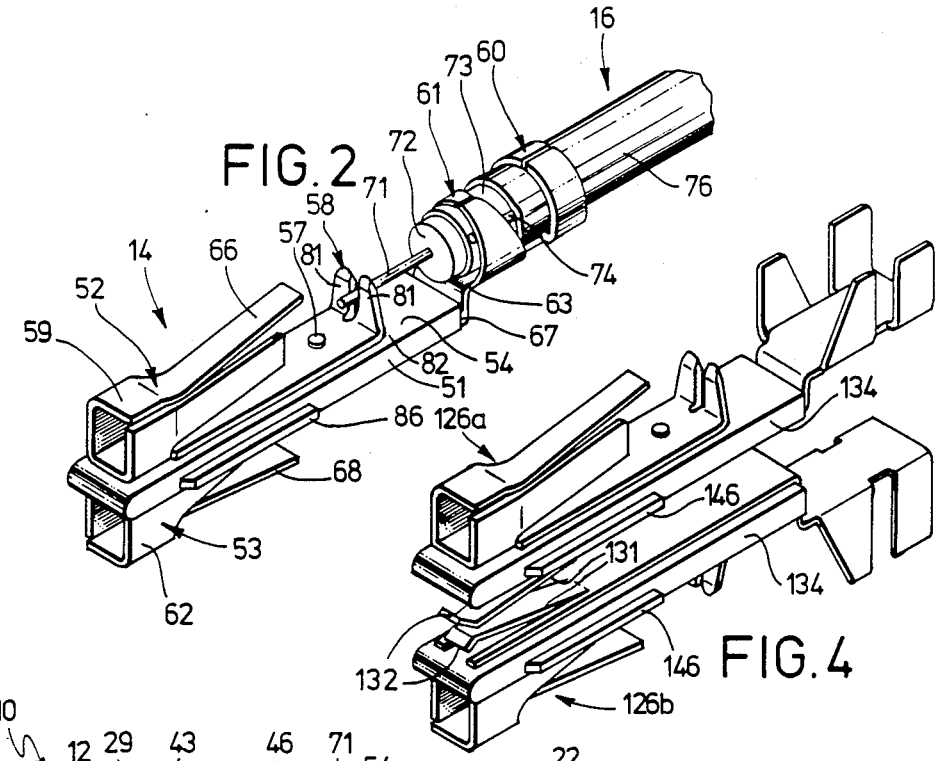
FIG. 2
FIG. 4
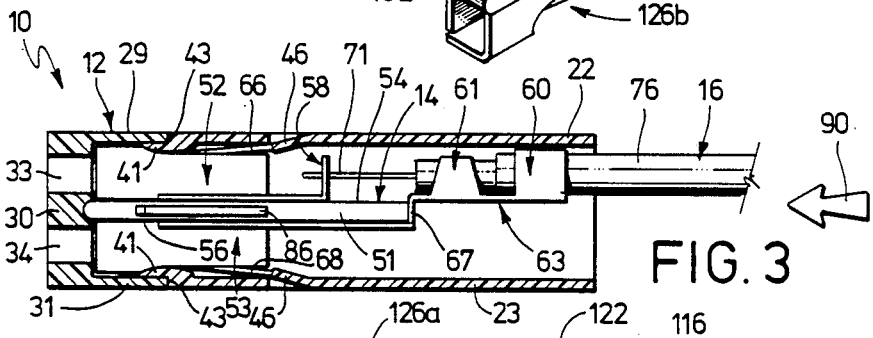
FIG. 3
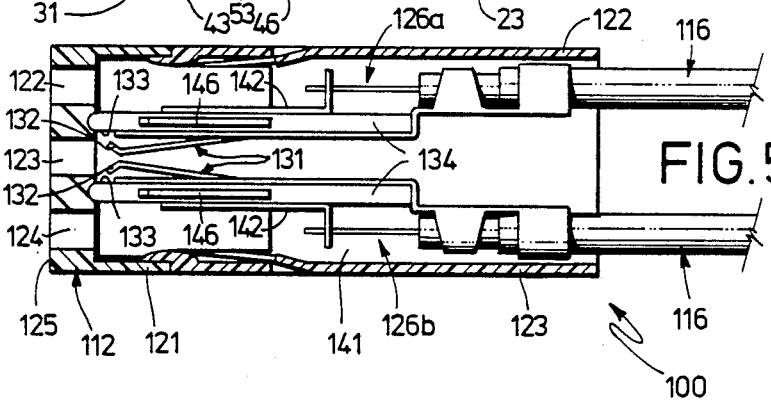
FIG. 5

HIGH-DENSITY, MODULAR, ELECTRICAL CONNECTOR

BACKGROUND OF THE INVENTION

The present invention relates generally to electrical connectors and, more particularly, to high-density, electrical connectors for discrete wire coaxial cable systems.

Modern electronic systems often require large numbers of coaxial cables to transmit signals to and from the system. Because of their relatively small diameter, many systems utilize discrete wire coaxial cables comprising a center, signal-carrying conductor, an outer, electrically conductive foil to provide shielding, and a drain wire connected to the foil to maintain the foil at a reference potential.

Efficient termination of discrete wire coaxial cable systems requires the use of high-density, electrical connectors, i.e., connectors capable of terminating a large number of discrete wire cables in a relatively small area. Known, high-density, electrical connectors, however, were not fully satisfactory.

In many prior high-density connectors, access to individual cables for servicing or replacement was not possible without disassembling at least a substantial portion of the connector and interrupting other circuits in the connector. In other known connectors, the cables were terminated by termination members capable of being separately inserted into or removed from a connector housing without disturbing other electrical connections in the housing. Generally, however, these connectors were complex in design and difficult to manufacture and assemble.

In one known high-density connector, each termination member comprised a plastic body which was molded around the end of a cable and electrical contacts attached to the center conductor and drain wire of the cable. The molding operation was time-consuming and increased the cost of the connector. Also, prior to molding, it was usually necessary to twist and bend the center conductor and/or the drain wire of the cable to properly position them for attachment to the contacts. These operations were also time-consuming, risked damage to the fragile drain wire and center conductor, and were not susceptible to high-speed production procedures.

Finally, many prior designs did not provide adequate flexibility in permitting connectors of diverse size and shape to be readily manufactured for use in different applications.

SUMMARY OF THE INVENTION

The present invention provides a high-density, electrical, connector for discrete wire coaxial cable systems which can be efficiently manufactured and assembled and which provides flexibility in design for use in diverse applications. The connector is particularly designed for terminating discrete wire coaxial cables comprising a center, signal-carrying conductor, an outer electrically conductive foil for shielding, and a drain wire electrically connected to the foil for maintaining the foil at a reference potential; and includes a termination member mounted to each of one or more cables and a connector housing for receiving the one or more termination members. Each termination member comprises a dielectric support having opposed first and second sides; a first, signal contact supported on the first side of the support; and a second, ground contact supported on the second side of the support, the first and second contacts having first and second cable termination portions adapted to be electrically attached to the center conductor and drain wire, respectively, of the cable, the first and second cable termination portions being positioned substantially in alignment with one another and with said cable.

In accordance with the present invention, each termination member includes a signal contact and a ground contact which are mounted on opposite sides of a dielectric support. When the termination member is positioned in the connector housing, the dielectric support functions as a housing wall to electrically isolate the contacts from one another. The first and second cable termination portions of the contacts, however, are positioned substantially in alignment with one another and with the cable such that the center conductor and drain wire of the cable can be attached to the contacts without it being necessary to bend or otherwise reroute them, permitting the attachments to be made more rapidly and with less risk of damage to the fragile center conductor and drain wire.

In accordance with a presently preferred embodiment, the first and second cable termination portions comprise first and second electrical connections for connecting the center conductor and drain wire to the first and second contacts, respectively. The ground contact further includes a third crimp connection for crimping the outer jacket of the cable to the termination member for securing the cable to the termination member and for providing strain relief. All three connections are preferably substantially aligned with one another and with the cable for ease in assembly, and provide reliable attachments that avoid the need for encapsulating the cable terminations in a molded body or the like.

Because of the fragile nature of the drain wire, the second connection preferably comprises an O-crimp which surrounds the cable and the exposed drain wire to capture the drain wire, rather than provide a pressure crimp therearound. Reliable electrical connection of the drain wire to the ground contact is preferably achieved by applying a solder coating to the O-crimp prior to crimping, and thereafter heating the crimp to soften the solder.

In accordance with a further aspect of the invention, each termination member can be inserted into or removed from the housing for servicing or replacement without disturbing other circuits in the connector. The housing comprises an assembly including one or more housing modules each having one or more termination member receiving passageways. This modular construction provides substantial flexibility in forming connectors of diverse shape and size for different applications.

In accordance with an alternative embodiment of the invention, the ground contacts of adjacent termination members can be oriented within the connector housing to permit both to be electrical connected to a single ground contact in a mating connector. This alternative construction permits an increase in connector density without increasing the complexity of the connector.

Further advantages and specific details of the invention will become apparent hereinafter in conjunction with the following detailed description of presently preferred embodiments.

BRIEF DESCRIPTION OF THE DRAWINGS

FIG. 2 is a perspective view illustrating the termination member of FIG. 1 attached to the end of a discrete wire coaxial cable;

FIG. 3 is a cross-sectional side view of the connector of FIG. 1 in assembled form;

FIG. 4 is a perspective view illustrating termination members according to an alternative embodiment of the invention;

FIG. 5 is a cross-sectional side view of a connector incorporating the termination members of FIG. 4.

DETAILED DESCRIPTION OF THE PREFERRED EMBODIMENTS

Figure 1:
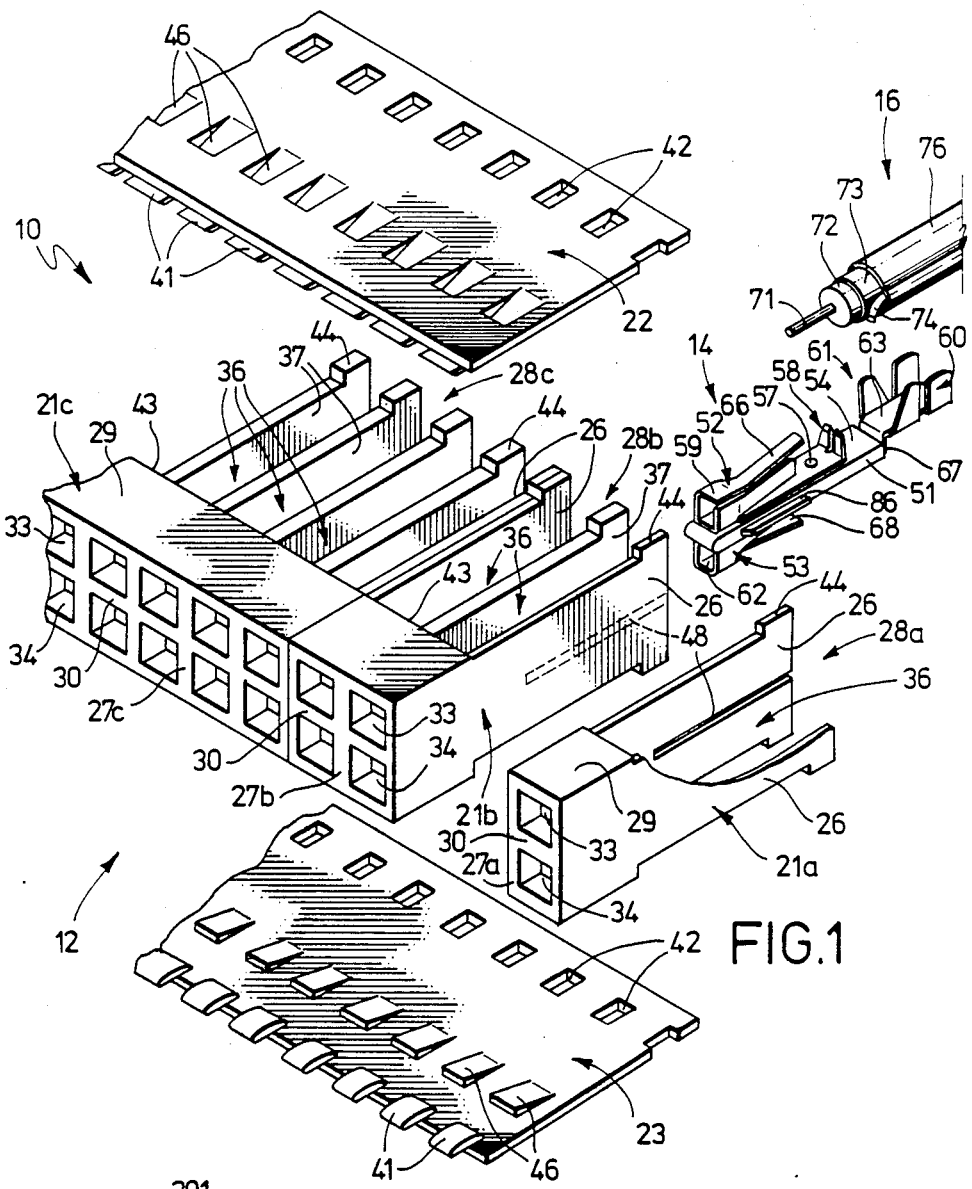
FIG. 1 is an exploded, perspective view of a high-density, electrical connector according to a presently preferred embodiment of the invention.

FIG. 1 is an exploded, perspective view of a high-density, modular, electrical connector according to a presently preferred embodiment of the invention. The connector is generally designated by reference numeral 10 and includes a plurality of termination members 14 (only one of which is shown in FIG. 1), and a connector housing 12 for receiving and supporting the plurality of termination members. Each termination member 14 is adapted to be attached to the end of an electrical cable generally designated by reference numeral 16.

Connector housing 12 comprises an assembly which includes a plurality of housing modules 21*a*, 21*b*, and 21*c*, an upper cover 22, and a lower cover 23. Each housing module 21*a*, 21*b*, and 21*c* comprises a molded, plastic component designed to receive one or more of the termination members 14. In the embodiment illustrated in FIG. 1, module 21*a* is configured to receive a single termination member; module 21*b* is designed to receive two termination members; and module 21*c* is designed to receive at least five termination members. In the embodiment of FIG. 1 also, the three modules 21*a*, 21*b* and 21*c* are positioned in side-by-side relationship, and upper and lower covers 22 and 23 are sized to cover and connect the three modules to complete housing assembly 12. It should be understood, however, that the housing assembly of FIG. 1 is intended to be exemplary only. The housing modules can be manufactured in any desired size and arranged in any desired manner to form connector housing 12. In general, the modular construction of the housing permits connectors of any desired size or configuration to be custom designed and quickly assembled from a limited number of standard modules and cover sizes depending on the requirements of particular connector applications.

Modules 21*a*, 21*b*, and 21*c* each include a pair of outer sidewalls 26 and a front wall 27*a*, 27*b*, and 27*c*, respectively. Modules 21*b* and 21*c* additionally include one or more intermediate sidewalls 37. The outer sidewalls 26 and/or the intermediate sidewalls 37 define passageways 36 therebetween for receiving termination members 14 as will be explained hereinafter. Outer sidewalls 26 of the modules are one-half the thickness of intermediate sidewalls 37 such that when the modules are positioned in side-by-side relationship as shown in FIG. 1, the abutting outer sidewalls 26 of adjacent modules will have a combined thickness equal to the thickness of intermediate sidewalls 37 such that the termination members will be uniformly spaced within the assembled connector housing 12.

Passageways 36 extend from the front walls 27*a*, 27*b*, 27*c* of the modules to the open back ends 28*a*, 28*b*, 28*c* thereof. The front walls of the modules include horizontal web portions 30 which define upper and lower apertures 33 and 34 aligned with each passageway 36 in the modules. The modules are substantially open on their top and bottom except for top and bottom wall portions 29 and 31 which extend rearwardly from the front walls thereof.

Upper and lower covers 22 and 23 are identical in shape and comprise substantially flat plates of plastic. Covers 22 and 23 each include a plurality of integral finger elements 41 extending forwardly from the front edge thereof and a plurality of apertures 42 adjacent the back edge thereof. Finger elements 41 and apertures 42 function to position and mount the covers to the modules during assembly of housing 12. More particularly, when the covers are mounted to modules 21*a*, 21*b*, and 21*c*, the plurality of finger elements 41 extend beneath rear edges 43 of upper and lower wall portions 29 and 31 of the modules (see FIG. 3); and the plurality of apertures 42 is positioned to receive a plurality of raised portions 44 on the top edge of the outer and intermediate sidewalls of the modules adjacent the back ends thereof. After being mounted onto the modules, the covers are preferably welded or otherwise bonded to the modules to complete the connector housing. When assembled, connector housing 12 comprises a rigid connector body which is mateable with a complementary connector (not shown) to complete electrical circuits through the connector.

As shown in FIGS. 1 and 3, covers 22 and 23 also include a plurality of retention features 46 for releasably retaining termination members 14 within passageways 36 of the modules, and outer sidewalls 26 and intermediate sidewalls 37 of the modules include internal longitudinal grooves 48 for orienting termination members 14 within the passageways as will be described more fully hereinafter.

Termination member 14, illustrated in greater detail in FIG. 2, comprises a flat, rectangular-shaped base 51, a signal contact 52, and a ground contact 53. Base 51 comprises a rigid, dielectric material such as glass-filled thermoplastic; and contacts 52 and 53 are mounted to upper and lower surfaces 54 and 56, respectively, of base 51 by plastic rivets 57 or other suitable fastening structure.

Signal contact 52 includes a center conductor termination portion 58 adapted to be attached to the center conductor 71 of a discrete wire coaxial cable 16, and a mating portion 59 adapted to mate with a signal contact in a complementary connector when the connectors are mated. Ground contact 53 includes a drain wire termination portion 61 adapted to be attached to the drain wire 74 of cable 16, and a mating portion 62 adapted to mate with a ground contact in a complementary connector. Ground contact 53 additionally includes a cable retention portion 60 for engaging the outer jacket 76 of cable 16 to attach the cable to termination member 14 and provide strain relief for the center conductor and drain wire of the cable. Cable retention portion 60 and drain wire termination portion 61 are formed on a portion 63 of ground contact 53 which extends beyond the back edge 67 of base 51.

Mating portions 59 and 62 of signal and ground contacts 52 and 53 are substantially identical in the embodiment of FIGS. 1-3 and comprise generally rectangular-shaped receptacles for receiving plug contacts in a complementary connector to complete electrical circuits through the connectors.

Termination members 14 are adapted to terminate discrete wire coaxial cables 16. Each cable 16 includes a central signal-carrying conductor 71 surrounded by a layer of insulation material 72, an electrically conductive foil 73 for shielding, and an insulating outer layer or jacket 76. Cable 16 also includes a drain wire 74 electrically connected to foil 73 to maintain the foil at a reference potential, usually ground.

Before attaching a cable 16 to a termination member 14, the cable is first prepared, as shown in FIG. 1, by removing a portion of. cover 76 to expose portions of foil 73 and drain wire 74. A lesser portion of inner insulation layer 72 is then removed to expose the center conductor 71. To attach a termination member 14 to the end of a cable 16, the end of the cable is first positioned on extended portion 63 of ground contact 53 such that jacket 76 is adjacent cable retention portion 60 and the exposed drain wire 74 is adjacent drain wire termination portion 61. When the cable is so positioned on extended portion 63 of ground contact 53, exposed center conductor 71 is aligned with and extends to center conductor termination portion 58 of signal contact 58 as shown in FIGS. 2 and 3. Center conductor termination portion 58 comprises a pair of upwardly-extending fingers 81 adjacent the rear end of signal contact 52 defining a narrow slot 82 therebetween through which the center conductor 71 extends. The center conductor is wedged in and along the slot 82 to form an electrical connection. Drain wire termination portion 61 and cable retention portion 60 each comprise crimps which are adapted to be crimped over the drain wire and around the cable jacket, respectively.

When cable 16 is properly positioned on termination member 14, crimp 60 is crimped around cable jacket 76, crimp 61 is crimped around cable 16 over exposed drain wire 74, and center conductor 71 is inserted into narrow slot 82 in portion 58.

Crimp 60 applies a pressure crimp around jacket 76 and functions to mechanically attach termination member 14 to the end of cable 16 and to provide strain relief for the center conductor and drain wire connections. Crimp 61 does not apply a pressure crimp around the fragile drain wire 74, but instead comprises an O-crimp around cable 16 which "captures" the drain wire therein. Reliable electrical connection of the drain wire to the ground contact is provided by a solder connection. In particular, a thin coating of solder is applied to crimp 61 and, after crimping, the solder is softened to electrically connect the drain wire to crimp 61 and, hence, to ground contact 53. A pressure crimp may be used for attaching the center conductor to signal contact 52, although a solder bond can also be provided if desired to supplement the pressure crimp.

As shown in the Figures, extended portion 63 of ground contact 53 extends upwardly around rear edge 67 of base 51 and rearwardly such that crimp connections provided by the crimps 60 and 61 on ground contact 53 are positioned on the same side of base 51 as connection 58 on signal contact 52. Thus, in the present invention, all three connections 58, 60, and 61 are substantially aligned with one another and with the cable 16. Alignment of the connections simplifies attachment of the termination member to the cable for increased manufacturing efficiency. Also, because the drain wire and center conductor termination portions of contacts 53 and 52 are aligned with the cable, it is not necessary to bend or otherwise reroute the drain wire and/or the center conductor for connection to the contacts. With the termination member of the present invention, reliable, electrical and mechanical connection of the cable to the termination member is achieved without it being necessary to encapsulate the connections in a molded body as in prior systems.

To complete the connector of the invention, the termination members 14 are inserted into termination member receiving passageways 36 of housing 12 from the open rear end of the modules as indicated by arrow 90 in FIG. 3. Insertion continues until the front ends of bases 51 impinge upon central web 30 of front wall 27 of a module. When the termination members 14 are fully inserted into passageways 36, removal thereof is prevented by retention features 46 on upper and lower covers 22 and 23 engaging spring fingers 66 and 68 on the signal and ground contacts, respectively. Removal of any termination member from housing 12, however, can easily be accomplished by simply inserting an appropriate tool into the back of the modules and deflecting appropriate retention features 46 on upper and lower covers 22 and 23 out of the way to free the termination member.

As shown in FIGS. 1 and 2, bases 51 of termination members 14 include longitudinal ribs 86 on either side thereof which are adapted to be received within grooves 48 in the outer and intermediate sidewalls of the modules to orient the termination members within the modules and to prevent the modules from rotating. When the termination members are positioned in housing 12, the mating contact portions 59 and 62 of the signal and ground contacts 52 and 53 are aligned with upper and lower apertures 33 and 34 in the front wall of the modules for mating with the contacts of a complementary connector. In addition, the support plate 51 of each termination member becomes an internal wall of the housing to electrically isolate the signal and ground contacts 52 and 53 from one another.

FIGS. 4 and 5 illustrate a high-density, electrical connector 100 according to an alternative embodiment of the invention. Connector 100 includes a plurality of termination members **126*a*, 126*b* adapted to terminate discrete wire coaxial cables 116, and a connector housing 112 composed of one or more housing modules 121, and top and bottom covers 122 and 123. Housing 112 in connector 100 is similar to housing 12 in connector 10 except that the housing modules 121 are somewhat higher to define higher termination member receiving passageways 141, and include three vertically arranged openings 122, 123, 124 in the front walls 125** thereof.

Termination member receiving passageways 141 are each adapted to receive two termination members **126*a* and 126*b* positioned one above the other as shown in FIGS. 4 and 5. Termination members 126*a* and 126*b* are identical to one another and differ from termination member 14 in the embodiment of FIGS. 1-3 only in the configuration of the mating portion 132 of ground contact 131. Specifically, mating portion 132 comprises a spring finger which extends outwardly and forwardly from surface 133 of dielectric base 134 of the termination member as shown in FIGS. 4 and 5. In other respects, termination members 126*a* and 126*b* are similar to termination member 14 and are electrically and mechanically attached to the ends of cables 116 in the same manner as in the embodiment of FIGS. 1-3**.

As shown in FIG. 5, termination member 126*a* is inserted into the upper portion of termination member receiving passageway 141 of module 121; and termination member 126*b* is inserted into the lower portion of the same passageway 141. Termination member 126*b*, however, is inserted into the passageway in an upside-down orientation such that adjacent ground contacts 131 on the two termination members face each other.

The outer and intermediate sidewalls of modules 121 preferably include two longitudinal grooves (not shown) positioned to receive ribs 146 on bases 134 of termination members 126*a* and 126*b* for positioning of the termination members in passageway 141.

When termination members 126*a* and 126*b* are positioned in a passageway 141, the mating portion of signal contact 142 of termination member 126*a* is aligned with upper opening 122 in front wall 126, and the mating portion of signal contact 142 in termination member 126*b* is aligned with lower opening 124. The mating portions 132 of ground contacts 131 of the two termination members are both aligned with central opening 123 and serve as resilient fingers to engage a conductive post contact, not shown, adapted for plugging into the opening 123. In this position, both ground contacts can be simultaneously electrically engaged by a single mating post contact extending through opening 123. Thus, in the embodiment of FIGS. 4 and 5, the ground contacts of two termination members share the same opening 123 in housing 112, permitting a reduction in the size of the housing and an increase in connector density.

Figure 6:
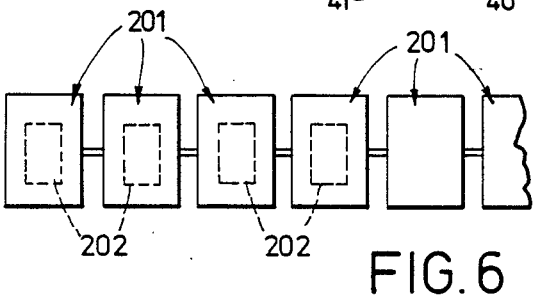
FIG. 6 schematically illustrates an improved method for manufacturing termination members according to the present invention.

FIG. 6 schematically illustrates a further important feature of the invention. The termination members of the present invention are particularly suitable for high-volume, mass-production-manufacturing procedures. As shown in FIG. 6, a plurality of dielectric termination member bases 201 can be manufactured in continuous strip form, using conventional injection molding procedures. The signal and ground contacts (schematically represented at 202) can be mounted to opposite sides of the bases while they are in strip form; and the bases separated from one another only with ready for attachment to cables. Manufacture of the termination members of the present invention can thus be accomplished more efficiently and with a greater degree of automation than in prior high-density connectors.

While what has been described constitutes presently preferred embodiments of the invention, it should be recognized that the invention could take numerous other forms. Accordingly, it should be understood that the invention should be limited only insofar as is required by the scope of the following claims.

We claim:

1. An electrical connector for terminating discrete wire coaxial cables, said discrete wire coaxial cables including a center signal-carrying conductor, an outer conductive foil for shielding, and a drain wire electrically connected to the foil for maintaining the foil at a reference potential, said connector including:

a termination member mounted to each of one or more of said cables, and a connector housing for receiving said one or more termination members, each of said termination members including:

a dielectric support having opposed first and second sides;

a first, signal contact supported on the first side of said support; and a second, ground contact supported on the second side of said support, said first and second contacts including first and second cable termination portions adapted to be electrically attached to the center conductor and drain wire, respectively, of said cable, said first and second cable termination portions being positioned substantially in alignment with one another and with the cable and comprising first and second electrical connections adapted to be connected to said center conductor and said drain wire, respectively, of said cable, said second connection comprising an O-crimp crimped around said cable for capturing said drain wire therein, and wherein said termination member further includes means for providing a solder bond between said O-crimp of said ground contact and said drain wire.

2. The connector of claim 1 wherein said cable includes an outer protective jacket and wherein said second, ground contact further includes means for attaching said second contact to the outer jacket of said cable.

3. The connector of claim 2 wherein said jacket-attaching means comprises a crimp adapted to be crimped around said outer jacket of said cable, said crimp being substantially aligned with said first connection and said O-crimp.

4. The connector of claim 3 wherein said second, ground contact includes an extended portion which extends around the back edge of said dielectric support, and wherein said crimps are positioned on said extended portion substantially in alignment with said first connection on said first contact and on the same side of said dielectric support as said first connection.

5. An electrical connector for terminating discrete wire coaxial cables, said discrete wire coaxial cables including a center signal-carrying conductor, an outer conductive foil for shielding, and a drain wire electrically connected to the foil for maintaining the foil at a reference potential, said connector including:

a termination member mounted to each of one or more of said cables, each of said termination members including:

a dielectric support having opposed first and second sides;

a first, signal contact supported on the first side of said support; and a second, ground contact supported on the second side of said support, said first and second contacts including first and second cable termination portions adapted to be electrically attached to the center conductor and drain wire, respectively, of said cable, said first and second cable termination portions being positioned substantially in alignment with one another and with the cable; and a connector housing for receiving said one or more termination members, said connector housing including:

a plurality of housing modules, each of said housing modules including at least one termination member receiving passageway for receiving a termination member therein; and cover means for attaching said plurality of modules together.

6. The connector of claim 5 wherein said cover means includes means for releasably retaining said termination members in said termination member receiving passageways of said housing modules.

7. The connnector of claim 5 wherein said cover means includes upper and lower covers.

8. The connector of claim 5 wherein said connector housing includes a plurality of termination member-receiving passageways, each of said passageways being adapted to receive two termination members therein, and wherein the second, ground contacts of said two termination members face each other within said passageway for electrical connection with a single ground contact in a complementary connector.

9. The connector of claim 8 wherein the second, ground contacts of said two termination members are adjacent one another within one of said passageways.

10. A high-density, electrical connector for terminating a plurality of electrical cables, said connector including:

a termination member mounted to each of said plurality of cables; and a housing for receiving said plurality of termination members, said housing comprising a plurality of housing modules, each of said housing modules having at least one termination member receiving passageway for receiving a termination member therein, and cover means for covering said plurality of modules and for attaching said plurality of modules together, said cover means including means for releasably retaining said plurality of termination members in said termination member receiving passageways of said modules.

11. The connector of claim 10 wherein said cover means comprises an upper cover and a lower cover, and wherein said retaining means comprises resilient fingers on said upper and lower covers for releasably retaining said termination members within said termination member-receiving passageways of said modules.

12. The connector of claim 10 wherein each of said termination member-receiving passageways is adapted to receive two termination members.

13. The connector of claim 10 wherein said termination member-receiving passageways include sidewalls defining said passageways, and wherein said sidewalls include first guide means adapted to cooperate with second guide means on said termination members for positioning said termination members in said passageways.

14. The connector of claim 13 wherein said first guide means and said second guide means comprises interengaging grooves and raised ribs for positioning said termination members in said passageways.

15. In an electrical connector for coaxial cable comprising, a conductive signal contact having a corresponding terminating portion for connection to a signal carrying conductor of a coaxial cable, a conductive ground contact having a corresponding terminating portion for connection to a ground conductor of a coaxial cable, a termination member including a dielectric support supporting the signal contact and the ground contact, the signal contact and the ground contact and the dielectric support comprising termination member, and a housing for receiving the termination member, the improvement comprising;

the terminating portions are in alignment with each other on the dielectric support prior to receipt of the termination member by the housing, a portion of the termination member is constructed for positioning a coaxial cable in alignment with the terminating portions, and the terminating portions are positioned with respect to said portion of the termination member for connection to corresponding signal carrying and ground conductors of a coaxial cable without a need for the corresponding signal carrying and ground conductors to be bent for routing to the terminating portions.

16. In an electrical connector as recited in claim 15, wherein the improvement further comprises; different sides of the dielectric support mounts the signal contact and the ground contact, and the terminating portion of the ground contact is positioned at the same one of said sides as is positioned the terminating portion of the signal contact.

17. In an electrical connector as recited in claim 15, wherein the improvement further comprises; spaced apart walls of the housing, the dielectric support engages the spaced apart walls and forms a wall of the housing separating said signal contact from said ground contact.

18. In an electrical connector as recited in claim 15, wherein the improvement further comprises; spaced apart walls of the housing are provided with corresponding grooves, and the dielectric support is received along said grooves.

19. In an electrical connector as recited in claim 15, wherein the improvement further comprises; a coating of solder on the terminating portion of the ground contact.

20. In an electrical connector as recited in claim 15, wherein the improvement further comprises; the terminating portion of the signal contact comprises a pair of fingers defining therebetween a slot for receiving a signal carrying conductor of a coaxial cable.

21. In an electrical connector as recited in claim 15, wherein the improvement further comprises; the ground contact includes said portion of said termination member constructed for positioning a coaxial cable in alignment with the terminating portions.

22. In an electrical connector as recited in claim 15, wherein the improvement further comprises; one of said contacts includes said portion of said termination member constructed for positioning a coaxial cable in alignment with the terminating portions.

23. In an electrical connector as recited in claim 15, wherein the improvement further comprises; a cable retention portion positioned on said termination member in alignment with said terminating portions, said portion of the termination member is constructed for positioning a coaxial cable in alignment with the terminating portions and in alignment with the cable retention portion.

24. In an electrical connector as recited in claim 23, wherein the improvement further comprises; said ground contact includes said cable retention portion.

25. In an electrical connector as recited in claim 15, wherein the improvement further comprises; a conductive second signal contact having a terminating portion for connection to a corresponding signal carrying conductor of a second coaxial cable, a conductive second ground contact having a terminating portion for connection to a corresponding ground conductor of a second coaxial cable, a second dielectric support for supporting the second signal contact and the second ground contact in said housing, with the second ground contact and the first recited ground contact facing each other in said housing.

26. In an electrical connector as recited in claim 25, wherein the improvement further comprises; means in the housing for receiving the first recited ground contact and the second ground contact between the first recited dielectric support and the second dielectric support.

27. In an electrical connector as recited in claim 25, wherein the improvement further comprises; means in the housing for receiving the first recited dielectric support and the second dielectric support between the first recited signal contact and the second signal contact.

28. In an electrical connector as recited in claim 25, wherein the improvement further comprises; the second signal contact and the second ground contact are supported on the second dielectric support and comprise a second termination member prior to receipt of the second termination member in the housing.

29. In an electrical connector as recited in claim 25, wherein the improvement further comprises; a first opening in the housing for alignment with the first recited signal contact, a second opening in the housing for alignment with the second signal contact, and a third opening in the housing for alignment with both the first recited ground contact and the second ground contact.

30. In an electrical connector as recited in claim 29, wherein the improvement further comprises; the third opening is between the first and the second openings.

31. In an electrical connector comprising first and second termination members supporting corresponding signal contacts for connection to corresponding signal carrying conductors of coaxial cables, and supporting corresponding ground contacts for connection to corresponding ground conductors of coaxial cables, and a housing for receiving the termination members, the improvement comprising; the termination members support the signal contacts and the ground contacts before the termination members are received in the housing, and the termination members support the ground contacts facing each other in the housing.

32. In an electrical connector as recited in claim 31, wherein the improvement further comprises; first and second openings in the housing for alignment with the corresponding signal contacts, and a third opening in the housing between the first and second openings and for alignment with the ground contacts.

33. In an electrical connector as recited in claim 31, wherein the improvement further comprises; a terminating portion of each of the signal contacts for connection to a corresponding signal carrying conductor, a terminating portion of each of the ground contacts for connection to a corresponding ground conductor, and a portion of each termination member is constructed for positioning a coaxial cable in alignment with a corresponding terminating portion of the signal contact and a corresponding terminating portion of the ground contact and the terminating portions are positioned with respect to the portion of the of the termination member for connection to corresponding signal carrying and ground conductors of a coaxial cable without the need for the corresponding signal carrying and ground conductors to be bent for routing to the terminating portions.

* * * * *